US005215026A

United States Patent [19]

Windelberg et al.

[11] Patent Number: 5,215,026

[45] Date of Patent: Jun. 1, 1993

[54] CONTAINER STOWING FRAMES FOR CONTAINERS OF DIFFERENT LENGTHS AND WIDTHS ON BOARD SHIP

[75] Inventors: Hans-Georg Windelberg; Fred Cravaack, both of Wismar, Fed. Rep. of Germany

[73] Assignee: MTW Schiffwerft GmbH, Wismar, Fed. Rep. of Germany

[21] Appl. No.: 827,128

[22] Filed: Jan. 28, 1992

[51] Int. Cl.[5] ..... B63B 25/00

[52] U.S. Cl. ..... 114/72; 114/75

[58] Field of Search ..... 114/65 R, 72, 73, 75, 114/76, 78, 79 R, 80, 83, 85

[56] References Cited

U.S. PATENT DOCUMENTS

| | | | |
|---|---|---|---|
| 2,919,662 | 1/1960 | Tobin | 114/75 |
| 3,380,422 | 4/1968 | Bachko | 114/72 |
| 3,452,699 | 7/1969 | Oshima | 114/72 |
| 3,583,350 | 6/1971 | Goldman | 114/72 |
| 3,827,384 | 8/1974 | Lunde et al. | 114/72 |
| 4,626,155 | 12/1986 | Huinsky et al. | 114/75 |
| 4,890,565 | 1/1990 | Kelly et al. | 114/72 |

*Primary Examiner*—Jesûs D. Sotelo
*Assistant Examiner*—Stephen Avila
*Attorney, Agent, or Firm*—Jordan and Hamburg

[57] ABSTRACT

Container stowing frames for container ships are provided with sets of steps. Different paired steps of paired sets of steps define different paired surfaces for abutting against the widthwise extremities of a container of a respective different predetermined width. Directly above each set of steps an outwardly curvilinearly flared surface defines a smooth, wide entrance leading to a respective set of steps.

6 Claims, 3 Drawing Sheets

CONTAINER STOWING FRAMES FOR CONTAINERS OF DIFFERENT LENGTHS AND WIDTHS ON BOARD SHIP

BACKGROUND OF THE INVENTION

The invention is applicable in cell guides on container ships and enables containers of standard sizes differing in length and width to be stowed.

The introduction of different length and width standards for containers makes it increasing more difficult to adjust the extent of the container stowing places to the changing variety of requirements. The adjustment is accomplished by the use of stowing frames of variable size on board ships. With the present state of the art, the stowing frames for containers can be varied in length as required. Insofar as the containers to be loaded are to loaded into container stowing frames of the same width dimension, considerable time and money must be spent for converting the container cell frame and the turnaround time of the ship is increased. The economics of container transport are thus adversely affected by the conversion associated therewith.

It is an object of the invention is to eliminate the demonstrated disadvantages with respect to costs and time and to increase the economic efficiency of container transport by sea.

It is a further object of the invention to provide cell guides on board ships for containers of different standard sizes in length and breadth.

SUMMARY OF THE INVENTION

According to the invention, the length, as well as the width of the containers in the cell guide can be varied.

For the acceptance of various widths of containers, fixed, stepped container cell guides are provided in the container stowing frame. To accommodate the different container lengths, the container stowing frames are constructed in a known manner as container stowing frames which are stationary or longitudinally displaceable.

Pursuant to the invention, cell guides for two different container widths are constructed in stepped fashion, so that one stepped container cell guidance system results. This stepped container cell guidance system has the lesser width on the inside and the greater width on the outside. With that, the conditions exist for stowing alternatively containers of different widths in one container cell guidance system.

The stepped container guidance system expands in the upwards direction, so that there is a smooth transition from the stepped region to a spherical entrance surface. This ensures that the container is introduced without problems into the stepped container cell guides. On being introduced into the cell guides, the container slides necessarily on the entrance surface over random slip lines into the cell guides that correspond to its dimensions in length and width. The invention creates the possibility of stowing containers of different length and width in one cargo hold area.

The invention is described in greater detail by means of drawings.

Figure 1:
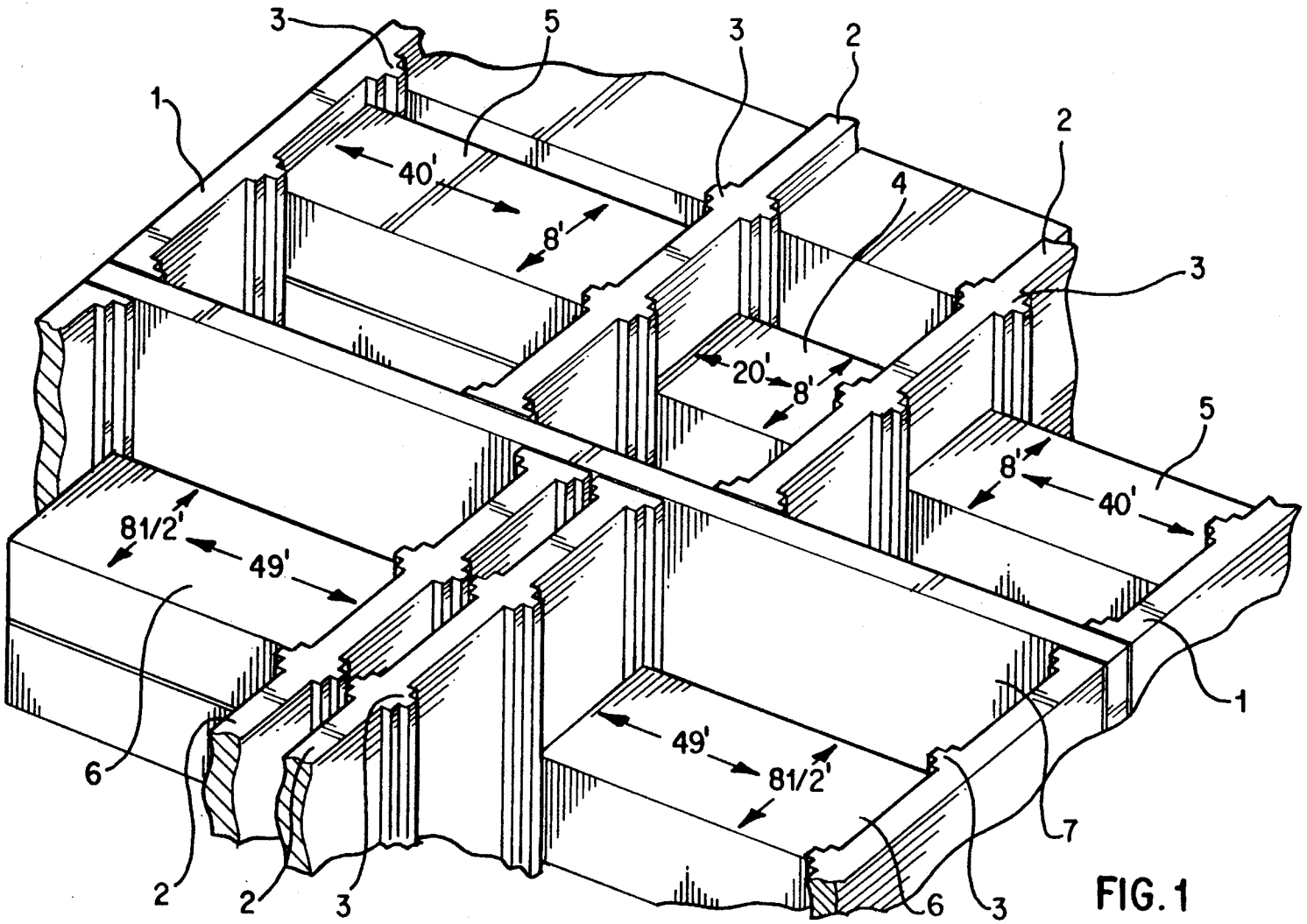
FIGS. 1 and 2 show possible ways of stowing containers of different length and width in one cargo hold area.

In order to meet the needs of containers of different widths, the container cell guides 3 on the container stowage frames 1 and 2, the stowage frames 1 and 2 being supported by longitudinal beam 7, are constructed in stepped fashion in such a manner, that the narrower width is on the inside and the greater width on the outside. In the entrance region, each stepped container cell guide 3 is expanded in the upwards direction.

There is a smooth transition from the stepped part of the container cell guides 3 to a spherical entrance surface 8. This ensures that the container is introduced without problems into the stepped container cell guides. As the container 4, 5 or 6 is being introduced into the stepped container cell guides 3, it slides necessarily on the random slip lines 9 or 10 of the entrance surfaces 8 into the stepped container cell guides 3 of the width and length intended for it. At the ends of the cargo area, the container stowing frames 1 are mounted in stationary fashion. Between them, the two container stowing frames 2 are constructed so as to be movable in the longitudinal direction.

FIG. 1 shows how it is possible to stow either two 49′ long containers or two 40′ long containers and one 20′ long container. For this purpose, the steps of the container cell guides 3 for accommodating the different container widths of 8½′ and 8′ are used.

Figure 2:
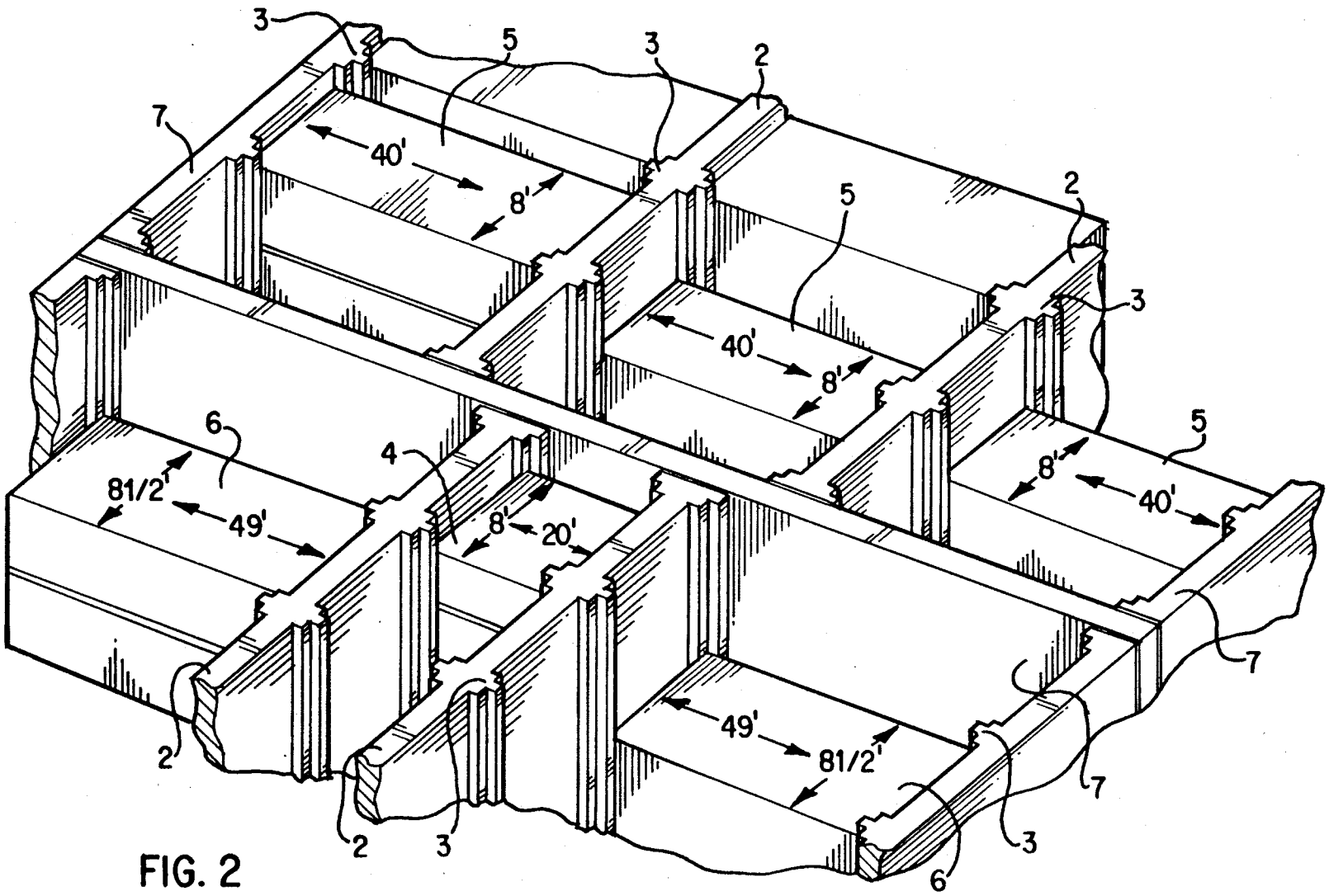
Figure 4:
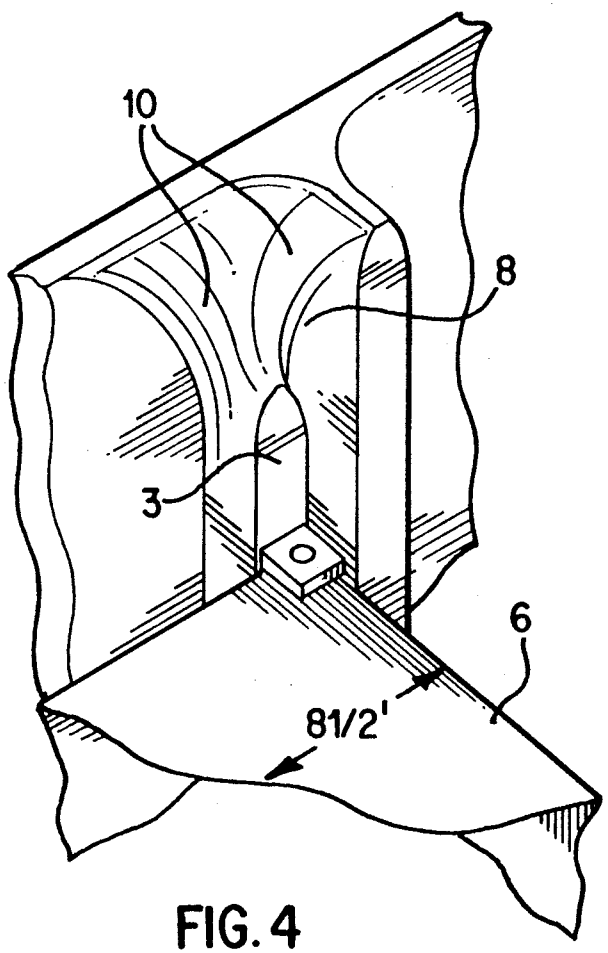
FIGS. 3 and 4 show the upper part of the container cell guides.
Figure 3:
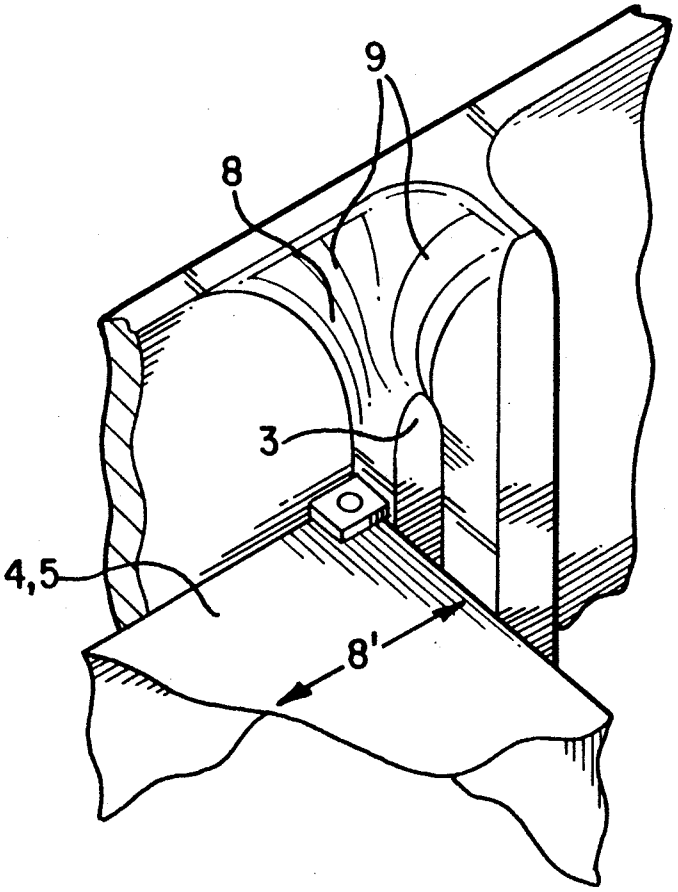

FIG. 2 shows how it is possible to stow either two 49′ long containers plus one 20′ long container or three 40′ long containers.

For this application also, the steps of the container guides 3 for accommodating the different container widths of 8½′ and 8′ are used.

In the case of the container arrangement shown in FIG. 1 for 49′ long containers, a certain amount of empty space remains between the two container stowing frames 2 to compensate for the structural tolerances.

For the arrangement of containers shown in FIG. 2, no empty space remains to compensate for structural tolerances. In this embodiment, the two container stowing frames 1 at the ends, which are normally stationary, can also be constructed so as to be adjustable, so as to ensure the required dimensional accuracy of the container stowing frames 1 and 2 in both applications.

Due to the invention, the stowage of containers of different lengths and different widths 4, 5, 6 in a loading area of container stowage frames 1 and 2 is ensured. It is merely necessary to shift the container stowage frames in the longitudinal direction in order to adapt them to the different loading cases.

We claim:

1. A system of container stowing frames for a container ship, wherein said containers have lengthwise and widthwise directions and lengths, widths and heights, comprising a pair of stowing frames each in the form of a wall extending in the widthwise direction of a container to be stowed by means of the stowing frames, at least one of the stowing frames being displaceable in the lengthwise direction of a container to be stowed to be adjustable to the length of the container, each stowing frame including at least two sets of fixed steps extending in the direction of the height of a container to be stowed by means of the stowing frames, the fixed steps of a first of said sets being paired with the fixed steps of a next adjacent second of said sets to correspond in spacing widthwise of the frame from said first set to said second set to a predetermined container width so that a container of one of at least two different predetermined widths is stowable with its widthwise extremities abutting a respective pair of the steps.

2. A system according to claim 1, wherein each set of said steps consists of two steps and one step of each set is an inside step for accommodating a container of first width and the other step of each set is an outside step for accommodating a container of a width wider than said first width.

3. A system according to claim 1, in which each frame has an upper extremity from above which a container to be stowed by means of the pair of frames is lowered to be brought into abutment with the pair of steps of each of the frame spaced corresponding to the width of the container, respective portions of the upper extremity of each frame outwardly flaring to form a curvilinear entry surface which smoothly merges into a respective one of the respective sets of steps to facilitate lowering of a container into said abutment with said pair of steps.

4. A system according to claim 3, in which said entry surfaces comprise random slip lines for said container being lowered.

5. The system according to claim 1 wherein said paired sets of fixed steps define tracks of two widths.

6. A system of container stowing frames for stowing containers of different dimensions in a container ship, comprising a pair of parallel spaced apart vertical stowing frames, each of said frames comprising a wall extending in a first horizontal direction, at least one of the stowing frames being displaceable in a second horizontal direction perpendicular to said first direction, each said stowing frame having a pair of horizontally spaced apart vertically extending container cell guides fixed on the side of the wall thereof toward the other of said stowing frames, said cell guides having stepped cross-sectional shapes with steps of pairs of opposed cell guides defining a vertical guide channel having a first dimension in said first direction; said walls of said stowing frames, between the container cell guides thereon, defining a vertical guide channel having a second dimension, in said first direction, that is less than said first dimension.

* * * * *